US007771080B2

(12) United States Patent
Platt

(10) Patent No.: US 7,771,080 B2
(45) Date of Patent: Aug. 10, 2010

(54) MULTIFUNCTION EDGE DEVICE FOR POWERED DOORS

(75) Inventor: Terence Christopher Platt, Berkshire (GB)

(73) Assignee: Memco Limited, Berkshire (GB)

( * ) Notice: Subject to any disclaimer, the term of this patent is extended or adjusted under 35 U.S.C. 154(b) by 523 days.

(21) Appl. No.: 10/553,934

(22) PCT Filed: Apr. 26, 2004

(86) PCT No.: PCT/GB2004/001764

§ 371 (c)(1),
(2), (4) Date: Aug. 16, 2006

(87) PCT Pub. No.: WO2004/094290

PCT Pub. Date: Nov. 4, 2004

(65) Prior Publication Data

US 2007/0064424 A1 Mar. 22, 2007

(30) Foreign Application Priority Data

Apr. 24, 2003 (GB) ..... 0309310.1

(51) Int. Cl.
*F21V 9/00* (2006.01)

(52) U.S. Cl. ..... 362/231; 362/230; 362/249.01; 362/249.02; 49/26; 187/317

(58) Field of Classification Search ..... 362/230, 362/231, 249, 94, 219; 49/26, 27, 28; 187/317, 187/313, 316, 393; 340/555; 318/466–470
See application file for complete search history.

(56) References Cited

U.S. PATENT DOCUMENTS

| | | | | |
|---|---|---|---|---|
| 3,875,456 | A | 4/1975 | Kano et al. | |
| 4,794,248 | A * | 12/1988 | Gray | 250/221 |
| 5,142,152 | A * | 8/1992 | Boiucaner | 250/341.7 |
| 5,149,921 | A * | 9/1992 | Picado | 187/317 |
| 5,161,879 | A * | 11/1992 | McDermott | 362/206 |
| 5,325,271 | A | 6/1994 | Hutchisson | |
| 5,420,430 | A * | 5/1995 | Trett | 250/341.1 |
| 2006/0243740 | A1 * | 11/2006 | Reynolds et al. | 222/52 |

FOREIGN PATENT DOCUMENTS

| | | | |
|---|---|---|---|
| DE | 195 36 451 | A1 | 4/1997 |
| EP | 0 350 154 | A2 | 1/1990 |
| EP | 1 258 395 | A2 | 11/2002 |
| JP | 7 137970 | A | 5/1995 |
| JP | 7 309568 | A | 11/1995 |
| JP | 8159871 | | 6/1996 |
| JP | 8 259156 | A | 10/1996 |
| JP | 10 087243 | A | 4/1998 |
| JP | 11335043 | | 12/1999 |
| JP | 2000 238985 | A | 9/2000 |
| WO | WO 00/77447 | A1 | 12/2000 |

* cited by examiner

*Primary Examiner*—Sandra L O'Shea
*Assistant Examiner*—Mary Zettl
(74) *Attorney, Agent, or Firm*—Hodgson Russ LLP

(57) ABSTRACT

An edge device for an elevator door includes an elongate array of infrared transmitters and/or receivers and a proximate elongate array of illuminable elements, both arrays extending for a substantial part of the length of the door. The illuminable elements are adapted to be illuminated when the door is in motion. The two arrays are disposed in a common carrier structure, being either vertically interleaved or extending vertically in parallel with each other.

32 Claims, 7 Drawing Sheets

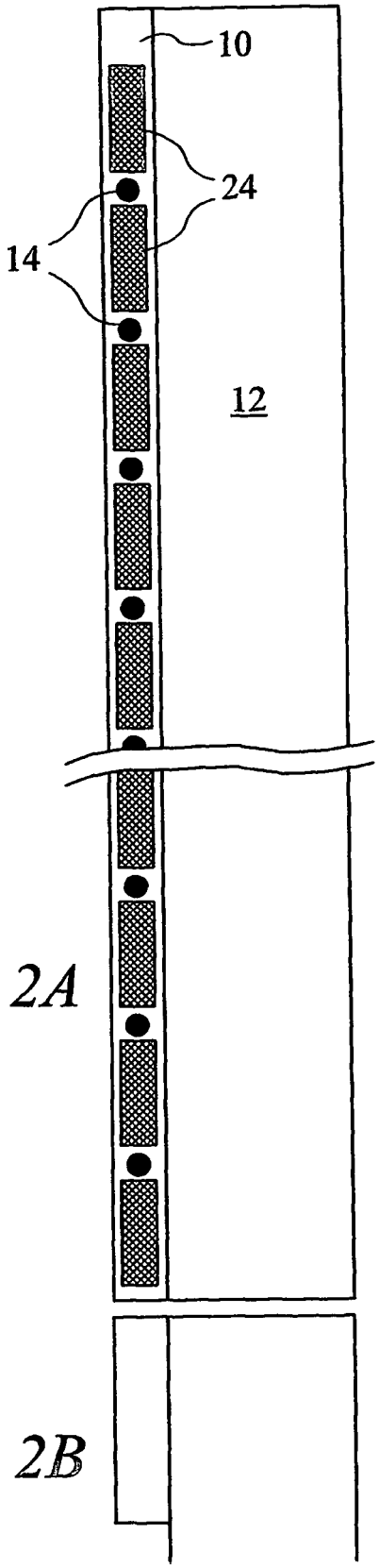
Fig. 2A
Fig. 2B
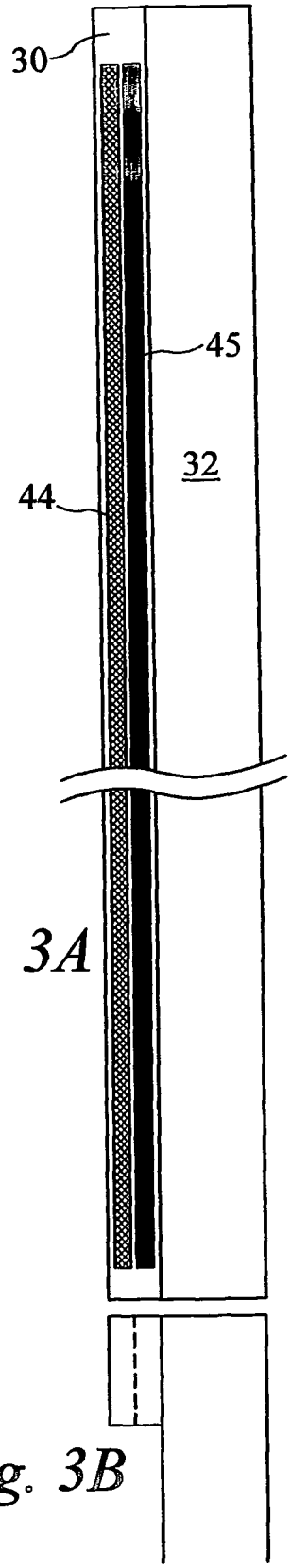
Fig. 3A
Fig. 3B

MULTIFUNCTION EDGE DEVICE FOR POWERED DOORS

The invention relates to an edge device for powered doors, such as elevator doors, and more particularly to an edge device that functions both as a safety sensor and as indicator lighting.

It is known to position infrared light detectors on the facing edges of elevator doors to allow beams to pass between those edges for preventing closure when persons are between the doors. One known system has a series of forty infrared transmitter diodes spaced in an array along substantially the whole length of one of the elevator doors, each diode transmitting a beam of infrared light, and a corresponding array of receiver diodes at respective facing positions on the other door for receiving the beams. An object passing between the doors breaks some of the beams, and the doors only close when all of the beams have been sensed by the corresponding receiver diodes. An improved version of such system, with a three-dimensional 'detection zone' is also known. The improved version has the pairs of diodes extending in a plane as described above, but has additional transmitter diodes that transmit infrared beams at an angle outwardly of that plane, and additional receiver diodes for receiving light reflected from the beams by an object which, although not yet in the plane, is close to entering the plane; for instance, a person approaching or standing in front of the doors. This is illustrated in FIG. 1.

For both practical and aesthetic reasons, visible lighting is desirable along the facing edges of elevator doors. In one aspect the present invention provides a means of achieving this. According to this aspect an edge device for a powered door comprises an elongate array of infrared transmitter and/or receiver elements, and an elongate array of illuminable elements adapted to be illuminated when the door is open so as to be visible to persons approaching the door, each illuminable element being itself elongated in the direction of elongation of the array, the illuminable elements being arranged substantively end-to-end.

There is only limited space to accommodate infrared detectors and lighting on the edges of the powered doors. Therefore preferably the infrared elements and the illuminable elements are disposed in a common carrier structure.

In another aspect, the subject invention provides an edge device for a powered door, comprising an elongate array of infrared transmitter and/or receiver elements and at least one illuminable element which extends with the array for a substantial part of the length thereof and which is adapted to be illuminated when the door is open so as to be visible to persons approaching the door, the infrared elements and the at least one illuminable element being disposed in a common carrier structure for a powered door, including an elongate array of infrared transmitters and/or receivers and at least one illuminable element which extends with the array for a substantial part of the length thereof and which is adapted to be illuminated when the door is open (i.e. fully open or moving between open and closed positions), the transmitter and/or receiver and the at least one illuminable element being disposed in a common carrier structure.

Preferably, in a first form of the edge device, the common carrier structure is a channel member; the at least one illuminable element may be a series of illuminable elements. The infrared transmitters and/or receivers may be vertically interleaved with the series of illuminable elements along the length of the array, each adjacent pair of the illuminable elements being separated by a respective infrared transmitter or receiver.

Preferably, in a second form of the edge device, the infrared elements extend vertically on a first side of the device, and the illuminable elements or series of illuminable elements extend vertically alongside the transmitters and/or receivers on a second side of the device. More preferably, the edge device also includes a barrier member extending longitudinally in the channel to separate the first and second sides of the common carrier structure.

The or each illuminable element may comprise a length of electroluminescent wire. Alternatively, the or each illuminable element maybe as set out below.

The invention also provides an edge device illuminable element having an elongate dimension and being configured to be disposed substantially end-to-end with other such elements, the element comprising at least one localised source of light, and a light-emitting surface disposed along said elongate dimension. The illuminable element may comprise a light-spreading lens (preferably a cover lens) and preferably also a diffuser for diffusing the spread light The lens may be cylindrical in one axis, with an elliptical outer curvature and an inner curvature such that light is constrained to leave the lens as a stripe with a generally equal light intensity at all points on the outer curvature. Preferably, the inner curvature has an eccentricity of unity or greater. More preferably, the inner curvature has a parabolic shape. Preferably, the lens is made of clear plastics material.

Alternatively, the or each illuminable element may comprise an elongate light-transmitting body having a reflective face, the light source being arranged to direct light toward the reflective face, the light reflecting therefrom exiting from the light-transmitting element via a further face thereof. There maybe a second light source arranged to direct light toward the reflective face, the light reflecting therefrom exiting from the light-transmitting element via said further face.

The element may comprise a diffuser for diffusing light exiting via said further face. The or each light source may be disposed at a respective end of the light-transmitting body.

In one embodiment an optical axis of the or each light source is directed along the axis of elongation of the light-transmitting body. Alternatively an optical axis of the or each light source is directed as a acute angle of the axis of elongation of the light-transmitting body so as to be incident on the reflective surface.

The light transmitting body may be of generally cylindrical section, the reflective surface being a portion (preferably a flattened portion) of a circumferential surface thereof. Alternatively the light transmitting body maybe of prismatic section, except at its ends.

Thus the element maybe a transparent block having a light diffuser on a front face, a reflective back face, and a side having a light source angled to direct light toward the back face, the light reflecting off the back face and being diffused by the diffuser on the front face. Each illuminable element may also have a second side having a second light source angled to direct light toward the back face, the light reflecting off the back face and being diffused by the diffuser on the front face. More preferably, the two sides are opposite sides of the transparent block. Each light source may emit light of a respective different colour.

The at least one illuminable element may include circuitry that is positioned so as to be isolated against interference from circuitry utilized by the elongate array of infrared transmitters.

The powered door may be an elevator door.

In another aspect, the invention is an illuminable element for an edge device, the illuminable element including a transparent body having a reflective rear face and a light diffuser on a front face. At least one light source is disposed at an angle to the rear face to direct light towards the rear face. The rear face reflects light from the light source toward the light diffuser, and the diffuser diffuses the light as it leaves the illuminable element.

Preferably, the at least one light source is a pair of light sources each positioned on a respective opposite side of the transparent body.

Preferably, each light source emits light of a respective different colour.

In a further aspect, the invention is an illuminable element that includes a light source, a light-spreading cover lens for redirecting light from the light source, and a light diffuser for diffusing the redirected light. The cover lens may be cylindrical in one axis with an elliptical outer curvature and an inner curvature such that light is constrained to leave the lens as a stripe with a generally equal light intensity at all points on the outer curvature.

Preferably, the inner curvature has an eccentricity of unity or greater, and more preferably, the inner curvature has a parabolic shape. Preferably the cover lens is made of clear plastic.

In the above embodiments, each light source may be a diode. The diode may be a bicolour or tricolour diode. The light sources or some of them may be driven by suitable drive circuitry so as to flash on and off as a warning that the door is about to close or is closing.

Preferred features of the present invention will now be described, by way of example only, with reference to the accompanying drawings, in which:

FIG. 2A is a front view of a first embodiment of the multifunction edge device of the subject invention secured to an elevator door, a series of infrared transmitters and/or receivers on the edge device being vertically interleaved with a series of illuminable elements;

FIG. 2B is a bottom view of the multifunction edge device and elevator door of FIG. 2A;

FIG. 3A is a front view of a second embodiment of the multifunction edge device of the subject invention secured to an elevator door, a series of infrared transmitters and/or receivers extending vertically in parallel with a series of illuminable elements on the edge device;

FIG. 3B is a bottom view of the multifunction edge device and elevator door of FIG. 3A;

Figure 1:
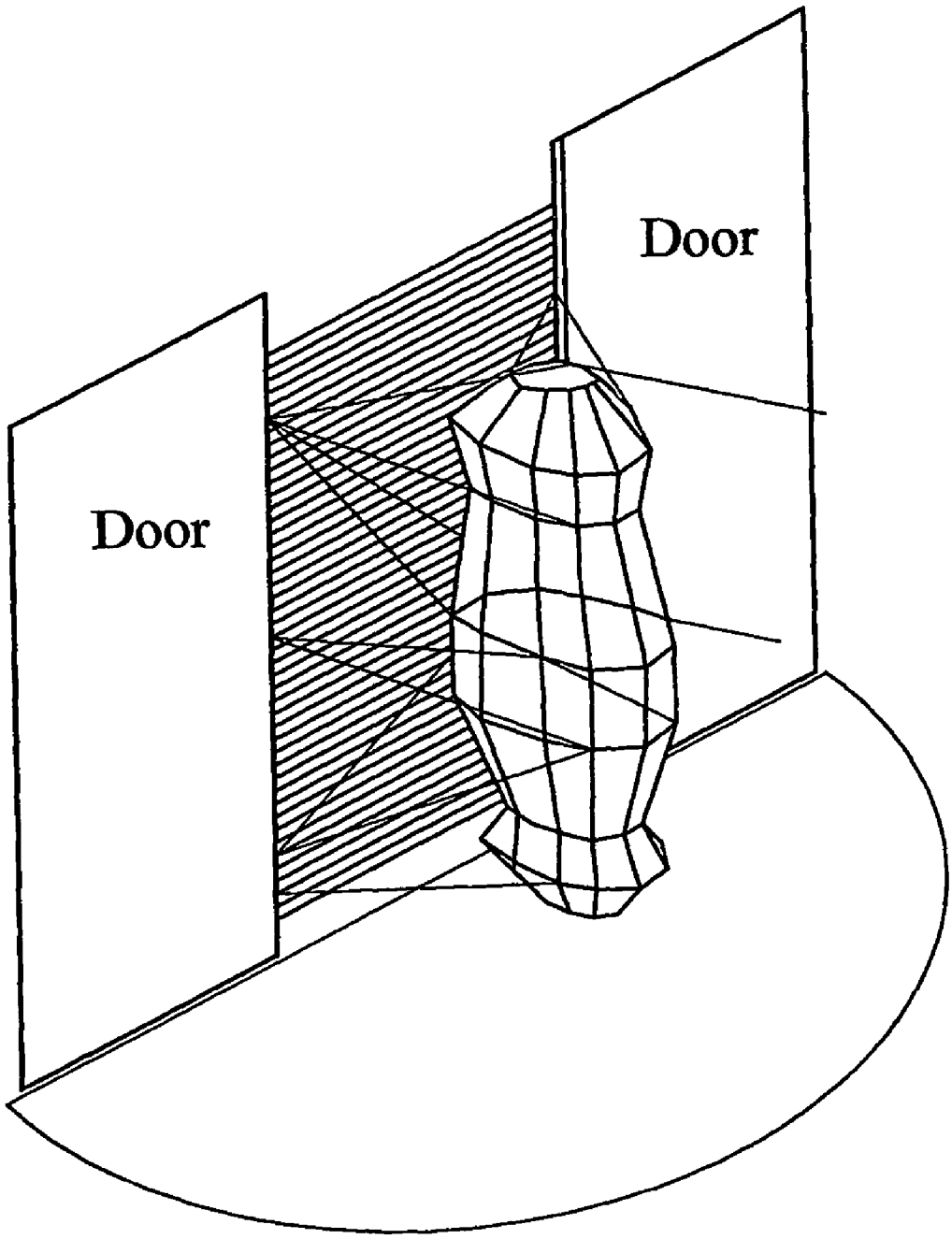
FIG. 1 is a prior-art perspective view of a pair of elevator doors with a three-dimensional detection zone created by a plurality of infrared transmitters and receivers on the door edges.
Figure 4:
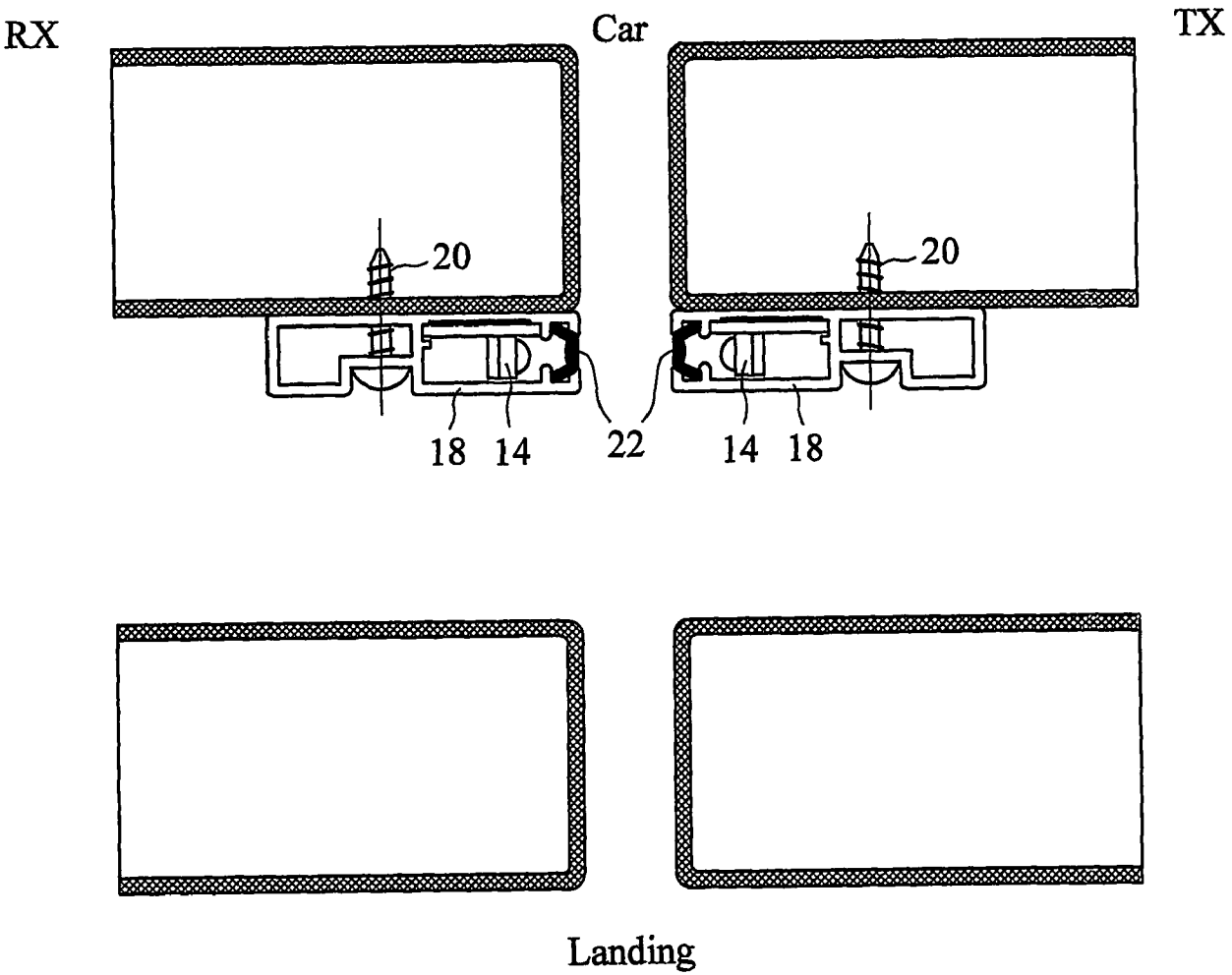
FIG. 4 is a plan view showing a pair of landing doors and also showing a pair of the multifunction edge devices of the first embodiment each secured to a front edge of a respective elevator door, the edge devices extending in the space existing between the elevator doors and landing doors.

The first embodiment of the invention is illustrated in FIGS. 2A, 2B and 4. In FIG. 2A, the edge device 10 is connected to a front edge of elevator door 12 and has a series of infrared transmitting and/or receiving devices 14 interleaved with a series of illuminable elements generally designated 16. The transmitting and/or receiving devices 14 are of the same type as those shown in prior-art FIG. 1. The illuminable elements 16 maybe of several types, as will be subsequently more fully described. The devices 14 and illuminable elements 16 share a common housing 18 (which can be metal or plastics material). As shown in FIG. 4, the housing 18 is secured to the elevator door 12 by a series of screws 20. The front of housing 18 is covered by a cover 22 which is transparent except for a series of rectangular windows 24, textured for diffusing visible light, as shown in FIG. 2A; as also shown in that figure, the infrared devices 14 show through at respective transparent portions of the cover 22.

The infrared receivers are 'blind' to the light of the coloured diodes because of inbuilt infrared filters, so there is no need to provide a cover screen. However, it may be necessary to separate and shield the illuminable-element circuitry from the infrared device circuitry because of possible interference.

Figure 5:
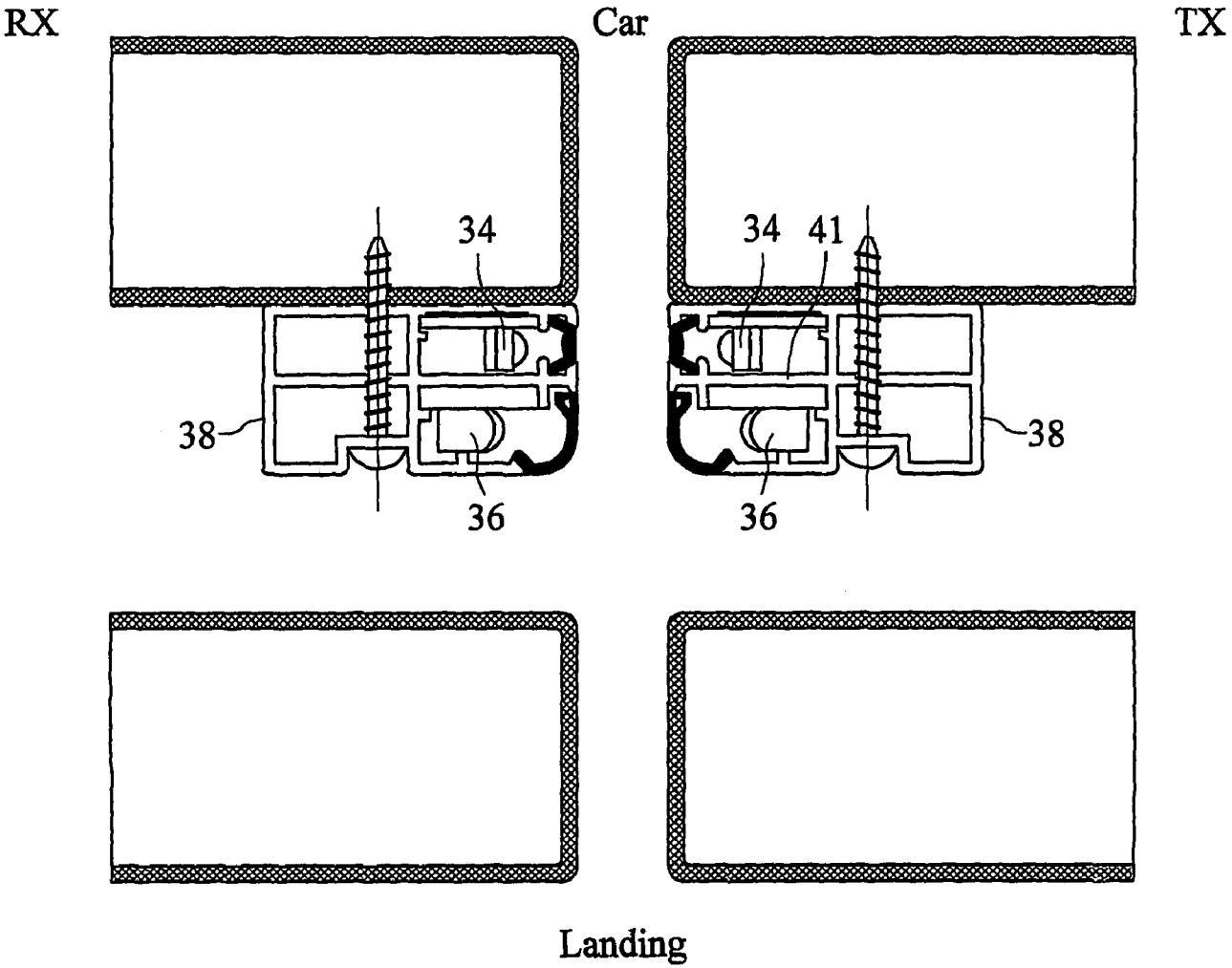
FIG. 5 is a plan view showing a pair of landing doors and also showing a pair of the multifunction edge devices of the second embodiment each secured to a front edge of a respective elevator door, the edge devices extending in the space existing between the elevator doors and landing doors.

The second embodiment of the invention is illustrated in FIGS. 3A, 3B and 5. In FIG. 3A, the edge device 30 is connected to a front edge of elevator door 32 and has a series of the infrared transmitting and/or receiving devices 34 extending in parallel with a series of the illuminable elements 36. The transmitting and/or receiving devices 34 are of the same type as those shown in prior-art FIG. 1. As with the first embodiment, the illuminable elements 36 may be of the types that are subsequently more fully described. The infrared devices 34 and illuminable elements 36 share a common housing 38 which is approximately twice as wide as the housing 18 of the first embodiment. As shown in FIG. 5, the housing 38 is secured to the elevator door 32 by a series of screws 40.

In FIG. 5, the infrared devices 34 and illuminable elements 36 are separated in the housing 38 by a central web 41. The front of housing 38 is covered by a cover 42 which is transparent except for a long narrow window 44, textured for diffusing visible light, as shown in FIG. 3A. A parallel second long narrow window is formed by a continuous infrared device cover 45 (shown in FIG. 5) that sits behind the transparent cover 42 and forward of a series of the infrared devices 14; the device cover 45 could be formed integral with the series of infrared devices 14 in the housing 38.

Figure 6A:
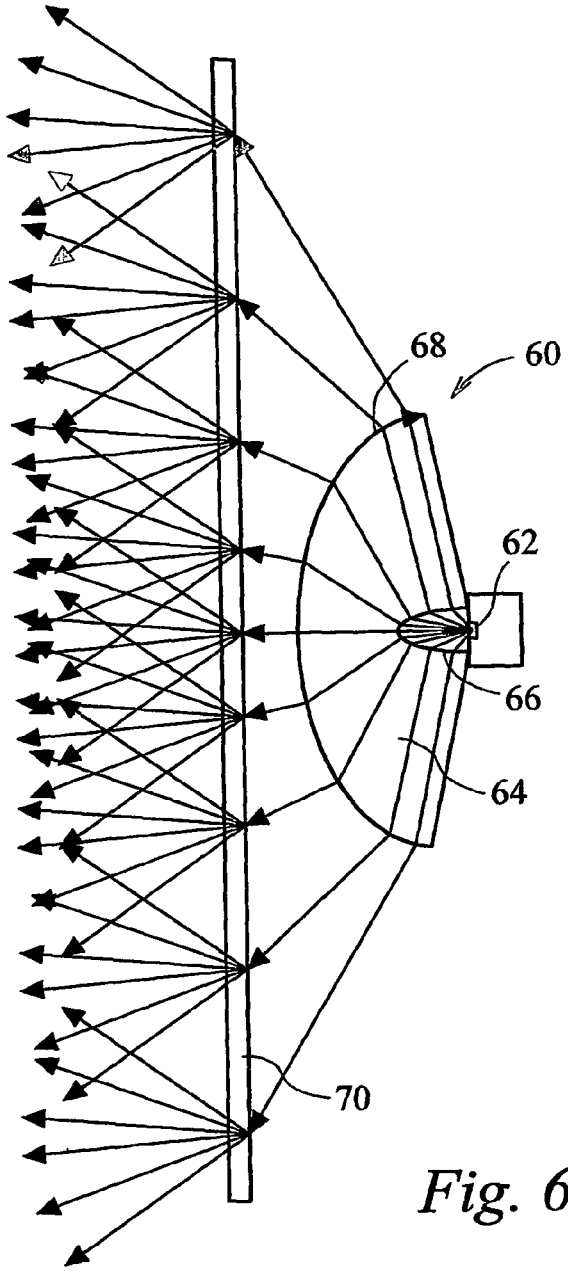
FIG. 6A is a side view of a beam-spreading lens assembly that may be used as the illuminable element.
Figure 6B:
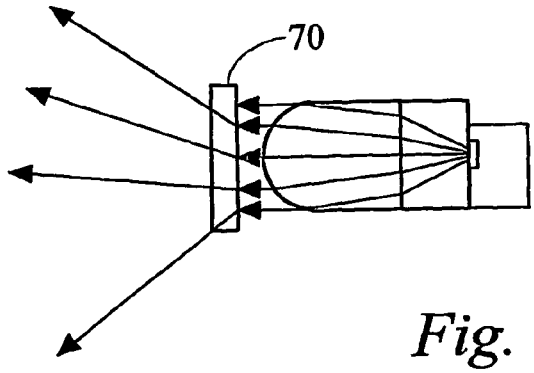
FIG. 6B is an end view of the beam-spreading lens assembly of FIG. 6A.

FIGS. 4 and 5 illustrate the relative position between pairs of elevator doors 12, 32, each carrying an edge device of the invention, and a respective pair of landing doors 26, 46, found on each floor of the building housing the elevator. The thickness of the edge devices is such that there is sufficient clearance between the outside of the devices and the surrounding stationary structure of the elevator well that vertical movement of the elevator car is not impeded. In the first and second embodiments, the RX and TX designations in FIGS. 4 and 5 are to indicate that all of the infrared receiver devices 14, 34, are on the respective left elevator door while all of the infrared transmitter devices 14, 34, are at respective opposite positions on the respective right elevator door. Each elevator door could, however, have both a series of transmitter devices and a series of receiver devices, with the complementary series of receiver devices and transmitter devices being on the other elevator door. As is evident from FIGS. 4 and 5, the external surfaces of the covers 22, 42 can be viewed obliquely, and thus are visible to a person approaching the door from either inside or outside the elevator Two types of illuminable elements 36 are shown in FIGS. 6 and 7. The first type 36A, shown in FIGS. 5, 6A and 6B, consists of a lens assembly generally designated 60 that comprises a coloured light-emitting diode (LED) 62 that sits within a cylindrical plastic lens 64 having a parabolic inner section 66 and an elliptical outer section 68. Although a parabolic inner section is used, the inner section could be any conic section that has an eccentricity of unity or greater. Combining a parabolic inner section with an elliptical outer section has been found to be very effective at producing even spreading of the light that passes through the plastic lens 64, and avoids a pattern of light emerging from the lens with a dim centre area and bright exterior areas or vice versa. The plastic lens 64 redirects light from the LED 62 so as to spread the light in the elongate direction of the array as it passes to the inside surface of the plastic diffuser 70. In the first and second embodiments, the plastic diffuser 70 is formed by the respective diffusing windows 24 and 44 described above. As can be seen in FIG. 6B the diffuser 70 diffuses the light both longitudinally and laterally of the elongate direction of the array.

Figure 7A:
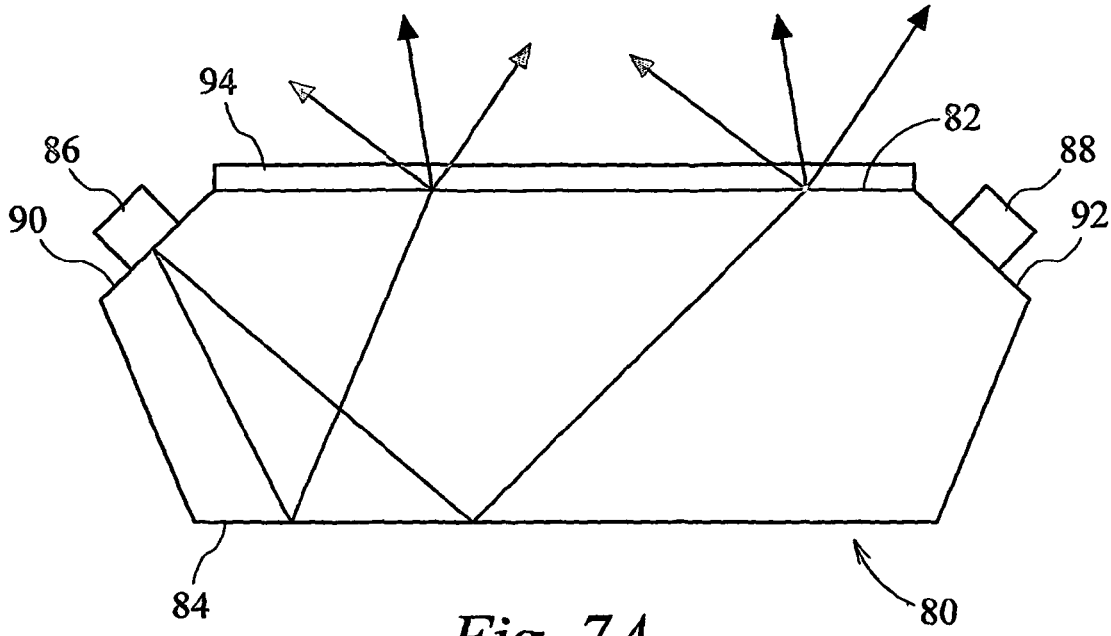
FIG. 7A is a side view of a transparent block that may be used as the illuminable element.
Figure 7B:
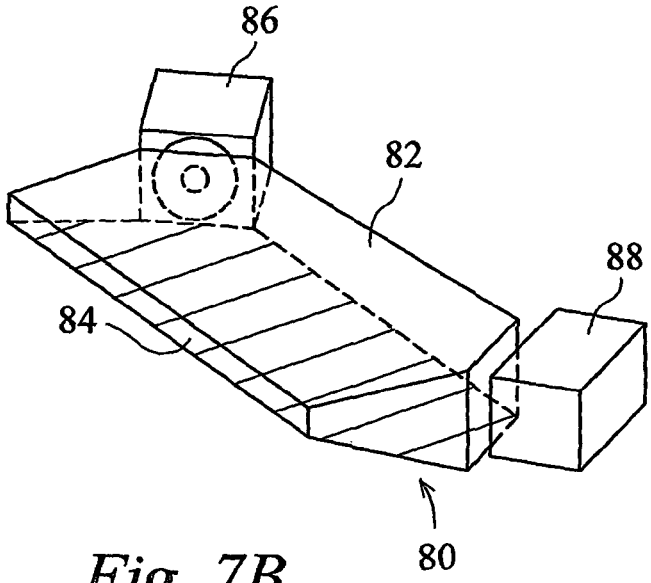
FIG. 7B is a perspective view of the illuminable element of FIG. 7A, and FIGS. 8 and 9 show further forms of illuminable element.

The second type 36B of illuminable element 36, shown in FIGS. 7A and 7B consists of a light-transmitting body in the form of a transparent plastic block 80 having a front face 82 and a reflective back face 84. At least one of the sides of block 80 has a bicolour or tricolour LED mounted thereon for transmitting light such that the light reflects off the back face 84 toward the front face 82. The embodiment of FIG. 7 has two LEDs 86, 88 mounted on respective angled positions 90, 92 of the ends of the block 80. A plastic diffuser 94 sits on the front face 82 of block 80. The plastic diffuser 94 may be formed by the diffusing window 24 or 44 of the respective first and second embodiments. It may be possible to dispense with the diffuser 94 if the reflective surface 84 can be sufficiently evenly illuminated by the LED(s), and/or if it is itself capable of scattering light incident upon it.

The block 80 is effectively a prismatic section, except strictly speaking for its ends which as mentioned above have angled or chamfered portions.

Figure 8:
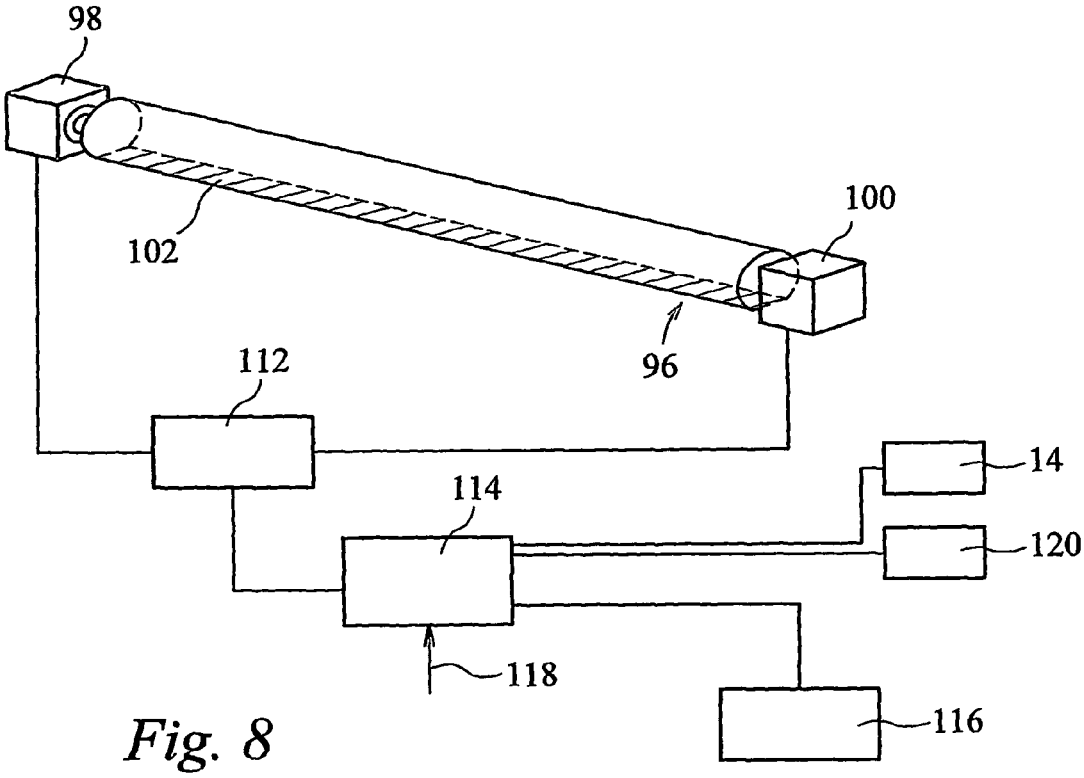

Referring to FIG. 8, another form of illuminable element has a light transmitting body 96 in the form of a cylinder of transparent acrylic plastics material (e.g. PERSPEX®) with red and green LEDs 98, 100 at respective ends thereof. The ends of the cylinder body 96 are normal to its longitudinal axis, and the LEDs are disposed with their optical axes directed along the length of the body 96. A flat rear surface 102 is provided along the length of the cylinder, e.g. by grinding or otherwise removing a segment of the cylindrical section. This flat surface is coated with a white reflective material so as to function analogously to the surface 84 of the FIG. 7 embodiment. Light from the LEDs is reflected and spread by the surface 102 and exits the cylinder via the curved surface opposite the surface 102, Being curved, this surface is particularly suited to be mounted in the edge devise so as to protrude to be easily visible by someone approaching the elevator doors. An additional diffuser element thus may not be necessary.

The LED(s) of each illuminable element of the foregoing embodiments are at least able to indicate one or both of the colours green and red. The following chart indicates the colours displayed with corresponding actions:

| Colour | Corresponding Action |
|---|---|
| 1. Green glow immediately: | Doors start to open; |
| 2. Red glow, after delay: | Doors are fully opened; |

-continued

| Colour | Corresponding Action |
|---|---|
| 3. Red glow, after delay: | Lift called to another floor; |
| 4. No glow: | Doors are fully closed; |
| 5. Flashing, then solid red | 'Close Doors' button pushed; |
| 6. Flashes red | Door nudging activated. |

The drive circuitry needed for operating the LEDs in this way is known per se in other fields, and its manner of implementation in the present novel application will be apparent to the man skilled in the art. An outline arrangement is shown in FIG. 8. Drive circuitry 112 for the LEDs 98,100 operates in response to commands from a controller 114 which also controls door operating gear 116. The controller is responsive to user input instructions 118 (e.g. from persons using the elevator), and to feedback from door position sensors 120 and the infrared receivers 14.

Besides the LEDs, an alternative light source in the form of newly-developed electroluminescent plastic wires, may be used. Such materials give out a rather dim light at present, but their light output is improving steadily. A binary or multi-element strip or wire of such plastic could be run alongside the infrared detector assembly and would not require the use of the diffuser previously mentioned. Various colours would be providing by activating one, or several, strips as necessary. Electroluminescent plastic wires would also allow complex shapes and multicolour patterns of light emission to be created. The wires are formed as coaxial cable, with phosphor (for example, ZnS) in the cylindrical region separating the two conductors of the cable.

Figure 9:
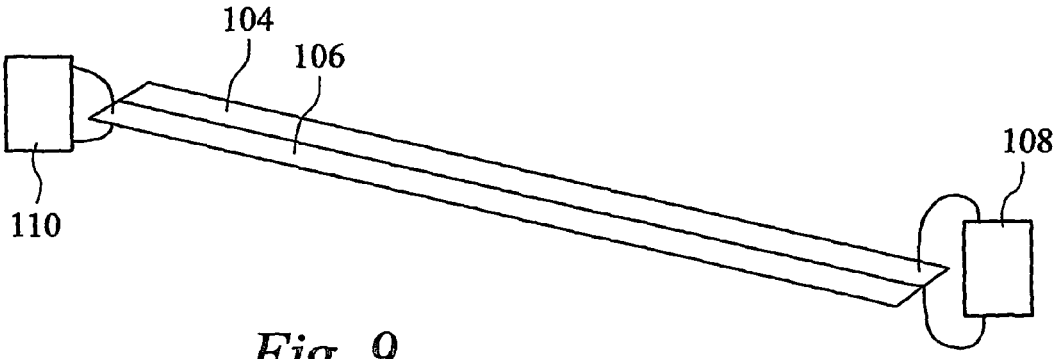

FIG. 9 illustrates a simple example of such a device. Two strips 104, 106 of electroluminescent material (one green, one red) are provided, each driven by a respective oscillator 108, 110 as known per se. Given the distributed nature of the light produced by the strips, a separate diffuser element may not be necessary and the strips can be mounted directly in the channel sections of FIGS. 4 and 5, on supports so that they form a flush edge in the same way as do the diffuser elements illustrated therein. The control arrangements for this embodiment correspond to those of FIG. 8.

All of the embodiments of illuminable element herein described lend themselves to arrangement as a elongate array with the elements substantially end-to-end, perhaps separated by the infrared elements in the inter leaved embodiment of FIG. 2. In the embodiment of FIG. 3 the elements may abut end to end (in the case of the FIG. 6 embodiment it is the diffuser elements 70 which will abut) or they maybe separated by the structure supporting the LEDs. The FIG. 9 embodiment is suitable for the installation of FIG. 2. It may alternatively be arranged as a single line of alternately red and green strips end-to-end which would lend itself to the structure of FIG. 3. Substantially end to end thus is to be interpreted to include the interposition of some relatively short structure between the elongate illuminable elements.

While the present invention has been described in its preferred embodiments, it is to be understood that the words which have been used are words of description rather than limitation, and that changes may be made to the invention without departing from its scope as defined by the appended claims.

Each feature disclosed in this specification (which term includes the claims) and/or shown in the drawings may be incorporated in the invention independently of other disclosed and/or illustrated features.

The text of the abstract filed herewith is repeated here as part of the specification.

An edge device for an elevator door includes an elongate array of infrared transmitters and/or receivers and a proximate elongate array of illuminable elements, both arrays extending for a substantial part of the length of the door. The illuminable elements are adapted to be illuminated when the door is in motion. The two arrays are disposed in a common carrier structure, being either vertically interleaved or extending vertically in parallel with each other.

The invention claimed is:

1. An edge device for a powered door of an elevator doorway, the edge device comprising:

an elongate array of infrared transmitter elements each of which emits infrared radiation for use in detecting objects proximate the elevator doorway, and an elongate array of illuminable elements each of which emits visible light to illuminate the elevator doorway when the door is open such that the visible light is visible to persons approaching the elevator doorway, wherein each illuminable element is elongated in the direction of elongation of the array; and, wherein the illuminable elements are arranged substantially end-to-end, wherein when in use the edge device is located in the elevator door.

2. The edge device of claim 1, wherein the infrared transmitter elements and the illuminable elements are disposed in a common carrier structure.

3. The edge device of claim 2, wherein the common carrier structure is a channel member.

4. The edge device of claim 1, wherein one or more of the illuminable elements each comprises a length of electroluminescent wire.

5. The edge device of claim 1, wherein the array of infrared transmitter elements and the array of illuminable elements are interleaved with one another.

6. An edge device for a powered door of an elevator doorway, the edge device comprising:

an elongate array of infrared transmitter elements each of which emits infrared radiation for use in detecting objects proximate the elevator doorway; and, at least one illuminable element which extends with the array of infrared transmitter elements for a substantial part of the length thereof, and which emits visible light to illuminate the elevator doorway when the door is open such that the visible light is visible to persons approaching the elevator doorway;

wherein the infrared transmitter elements and the at least one illuminable element are disposed in a common carrier structure, wherein when in use the edge device is located in the elevator door.

7. The edge device of claim 6, wherein the common carrier structure is a channel member.

8. The edge device of claim 7, wherein the at least one illuminable element comprises an array of illuminable elements.

9. The edge device of claim 8, wherein the infrared transmitter elements are vertically interleaved with the array of illuminable elements along the length of the array, each adjacent pair of the illuminable elements being separated by a respective infrared transmitter element.

10. The edge device of claim 9, wherein the infrared transmitter elements extend vertically on a first side of the device, and the array of illuminable elements extend vertically alongside the infrared transmitter elements on a second side of the device.

11. The edge device of claim 6, wherein the common carrier structure is a channel member, wherein the infrared transmitter elements extend vertically on a first side of the channel member wherein the at least one illuminable element comprises an array of illuminable elements, and wherein the array of illuminable elements extends vertically alongside the infrared transmitter elements on a second side of the channel member, the edge device further comprising a barrier member extending longitudinally in the channel member to separate the first and second sides of the channel member.

12. The edge device of claim 6, wherein the at least one illuminable element includes circuitry that is positioned so as to be isolated against interference from circuitry utilized by the infrared transmitter elements.

13. The edge device of claim 6, comprising drive circuitry configured to cause the at least one illuminable element to flash as an indication that the door is closing or is about to close.

14. The edge device of claim 6, wherein the at least one illuminable element comprises a length of electroluminescent wire.

15. An edge device for a powered door of an elevator doorway, the edge device comprising:

an elongate array of infrared receiver elements each of which receive infrared radiation for use in detecting objects proximate the elevator doorway; and an elongate array of illuminable elements each of which emits visible light to illuminate the elevator doorway when the door is open such that the visible light is visible to persons approaching the elevator doorway;

wherein each illuminable element is elongated in the direction of elongation of the array; and, wherein the illuminable elements are arranged substantially end-to-end, wherein when in use the edge device is located in the elevator door.

16. The edge device of claim 15, wherein the array of infrared receiver elements and the array of illuminable elements are interleaved with one another.

17. The edge device of claim 15, wherein the infrared receiver elements and the illuminable elements are disposed in a common carrier structure.

18. The edge device of claim 17, wherein the common carrier structure is a channel member.

19. The edge device of claim 15, wherein one or more of the illuminable elements each comprises a length of electro-luminescent wire.

20. An edge device for a powered door of an elevator doorway, the edge device comprising;

an elongate array of infrared transmitter elements each of which emits infrared radiation for use in detecting objects proximate the elevator doorway;

wherein the elongate array further comprises infrared receiver elements each of which receives infrared radiation for use in the detection of said objects proximate the elevator doorway, and, an elongate array of illuminable elements each of which emits visible light to illuminate the elevator doorway when the door is open such that the visible light is visible to persons approaching the elevator doorway;

wherein each illuminable element is elongated in the direction of elongation of the array; and, wherein the illuminable elements are arranged substantially end-to-end, wherein when in use the edge device is located in the elevator door.

21. An edge device for a powered door of an elevator doorway, the edge device comprising:

an elongate array of infrared receiver elements each of which receives infrared radiation for use in detecting objects proximate the elevator doorway; and, at least one illuminable element which extends with the array of the infrared receiver elements for a substantial part of the length thereof, and which is each of which emits visible light to illuminate the elevator doorway when the door is open such that the visible light is visible to persons approaching the elevator doorway;

wherein the infrared receiver elements and the at least one illuminable element are disposed in a common carrier structure, wherein when in use the edge device is located in the elevator door.

22. The edge device of claim 21, wherein the common carrier structure is a channel member.

23. The edge device of claim 22 wherein the at least one illuminable element comprises an array of illuminable elements.

24. The edge device of claim 23, wherein the infrared receiver elements are vertically interleaved with the array of illuminable elements along the length of the array, each adjacent pair of the illuminable elements being separated by a respective infrared receiver element.

25. The edge device of claim 24, wherein the infrared receiver elements extend vertically on a first side of the device, and the array of illuminable elements extend vertically alongside the infrared receiver elements on a second side of the device.

26. The edge device of claim 21, wherein the common carrier structure is a channel member, wherein the array of infrared receiver elements extends vertically on a first side of the channel member, wherein the at least one illuminable element comprises an array of illuminable elements, and wherein the array of illuminable elements extends vertically alongside the infrared receiver elements on a second side of the channel member, the edge device further comprising a barrier member extending longitudinally in the channel member to separate the first and second sides of the channel member.

27. The edge device of claim 25, wherein the at least one illuminable element includes circuitry that is arranged so as to be isolated against interference from circuitry utilized by the infrared receiver elements.

28. The edge device of claim 25, comprising drive circuitry configured to cause the at least one illuminable element to flash as an indication that the door is closing or is about to close.

29. The edge device of claim 21, wherein the at least one illuminable element comprises a length of electroluminescent wire.

30. An edge device for a powered door of an elevator doorway, the edge device comprising:

an elongate array of infrared transmitter elements each of which emits infrared radiation for use in detecting objects proximate the elevator doorway, wherein the elongate array further comprises infrared receiver elements each of which receives infrared radiation for use in detection of said objects proximate the elevator doorway; and, at least one illuminable element which extends with the array of infrared transmitter and receiver elements for a substantial part of the length thereof, and which is each of which emits visible light to illuminate the elevator doorway when the door is open such that the visible light is visible to persons approaching the elevator doorway;

wherein the infrared transmitter and receiver elements and the at least one illuminable element are disposed in a common carrier structure, wherein when in use the edge device is located in the elevator door.

31. An edge device for a powered door of an elevator doorway, the edge device comprising:

an elongate array of infrared transmitter elements each of which emits infrared radiation for use in detecting objects proximate the elevator doorway;

and an elongate array of illuminable elements each of which emits visible light to illuminate the elevator doorway when the door is open such that the visible light is visible to persons approaching the elevator doorway, wherein when in use the edge device is located in the elevator door.

32. An edge device for a powered door of an elevator doorway, the edge device comprising:

an elongate array of infrared receiver elements each of which receives infrared radiation for use in detecting objects proximate the elevator doorway;

and an elongate array of illuminable elements each of which emits visible light to illuminate the elevator doorway when the door is open such that the visible light is visible to persons approaching the elevator doorway, wherein when in use the edge device is located in the elevator door.

* * * * *

UNITED STATES PATENT AND TRADEMARK OFFICE

CERTIFICATE OF CORRECTION

PATENT NO. : 7,771,080 B2
APPLICATION NO. : 10/553934
DATED : August 10, 2010
INVENTOR(S) : Platt It is certified that error appears in the above-identified patent and that said Letters Patent is hereby corrected as shown below:

Col. 9, Claim 21, line 8, the phrase "and which is" should be deleted;

Col. 9, Claim 27, line 1, "claim 25" should read --claim 21--;

Col. 9, Claim 28, line 1, "claim 25" should read --claim 21--; and

Col. 10, Claim 30, line 12, the phrase "and which is" should be deleted.

Signed and Sealed this

Sixteenth Day of November, 2010

David J. Kappos

David J. Kappos
*Director of the United States Patent and Trademark Office*